United States Patent [19]

Merten et al.

[11] 4,275,927

[45] Jun. 30, 1981

[54] MINERAL MINING PLOUGH WITH WORM ADJUSTABLE ROOF CUTTER

[75] Inventors: Gerhard Merten, Lunen; Oswald Breuer, Dortmund-Husen.; Bernd Steinkuhl, Lunen, all of Fed. Rep. of Germany

[73] Assignee: Gewerkschaft Eisenhutte Westfalia, Lunen, Fed. Rep. of Germany

[21] Appl. No.: 65,488

[22] Filed: Aug. 10, 1979

[30] Foreign Application Priority Data

Aug. 18, 1978 [DE] Fed. Rep. of Germany ..... 2836133

[51] Int. Cl.[3] ..... E21C 27/44

[52] U.S. Cl. ..... 299/34; 299/80

[58] Field of Search ..... 299/32, 34, 80; 175/382, 384

[56] References Cited

FOREIGN PATENT DOCUMENTS

| | | | |
|---|---|---|---|
| 1170350 | 5/1964 | Fed. Rep. of Germany | 299/34 |
| 1266174 | 5/1961 | France | 299/80 |
| 540036 | 12/1976 | U.S.S.R. | 299/34 |

*Primary Examiner*—Ernest R. Purser

*Attorney, Agent, or Firm*—Sughrue, Rothwell, Mion, Zinn and Macpeak

[57] ABSTRACT

A mineral mining plough has a plough body provided with a carrier supporting roof-level cutters. The carrier is movable vertically with respect to the plough body so as to adjust the cutting level of the roof-level cutters. A worm mounted on the plough body and a toothed rack attached to the carrier constitute means for adjusting the vertical position of the carrier, the worm meshing with the toothed rack.

6 Claims, 3 Drawing Figures

MINERAL MINING PLOUGH WITH WORM ADJUSTABLE ROOF CUTTER

BACKGROUND TO THE INVENTION

This invention relates to a plough for winning material such as coal, from a mineral face or seam in a mine working.

In order to win coal in the roof zone of a mine working, particularly in seams of varying thickness, it is known to provide coal ploughs with roof cutters mounted on a vertically adjustable carrier. Such a carrier may be held against the roof of the mine working by, for example, compression springs, hydraulic rams, or by manually adjustable displacement devices such as spindle-actuated thrust rods or lever-actuated ratchets. (see DE-PS No. 1,170,350, DE-OS No. 2,518,221 and DE OS No. 2,309,820)

Known displacement devices have the disadvantage that they require a relatively large space for their installation on the plough body, and particularly for short ploughs, such space is often not available. A further disadvantage of known displacement devices is their susceptibility to contamination and corrosion which adversely affects their efficiency. Moreover, the known displacement devices can only be adjusted in discrete steps.

The aim of the invention is to provide a plough having a displacement device for the carrier of its roof cutters, which displacement device does not suffer from these disadvantages.

SUMMARY OF THE INVENTION

The present invention provides a plough for winning material from a mineral face, the plough having a plough body, a carrier for roof-level cutters, and means for adjusting the vertical position of the carrier with respect to the plough body, wherein the adjusting means is constituted by a worm mounted on the plough body and a toothed rack associated with the carrier, the worm meshing with the toothed rack.

The worm and toothed rack constitute a worm drive which enables the vertical height of the carrier to be continuously adjusted. Moreover, by using a single-turn thread or a double-turn thread on the worm, the axial length of the worm can be minimised. Consequently, the worm takes up very little space on the plough body. Furthermore, the meshing of the worm with the toothed rack provides a self-cleaning action for the worm drive, as the rotation of the worm forces out foreign matter from between the teeth of the rack.

Advantageously, the toothed rack is formed on a slider which is attached to the carrier, the slider being vertically slidable within a guide formed in the plough body, and the guide is a vertical T-shaped groove in the plough body. Preferably, the worm is housed in a chamber formed at the top of the plough body.

Conveniently, the worm is rotatable by means of a lever attached to the upper end thereof, and stop means are provided on the plough body for securing the lever against rotation for all vertical settings of the carrier.

BRIEF DESCRIPTION OF DRAWINGS

One form of coal plough constructed in accordance with the invention will now be described, by way of example, with reference to the accompanying drawings, in which.

DESCRIPTION OF PREFERRED EMBODIMENT

Figure 1:
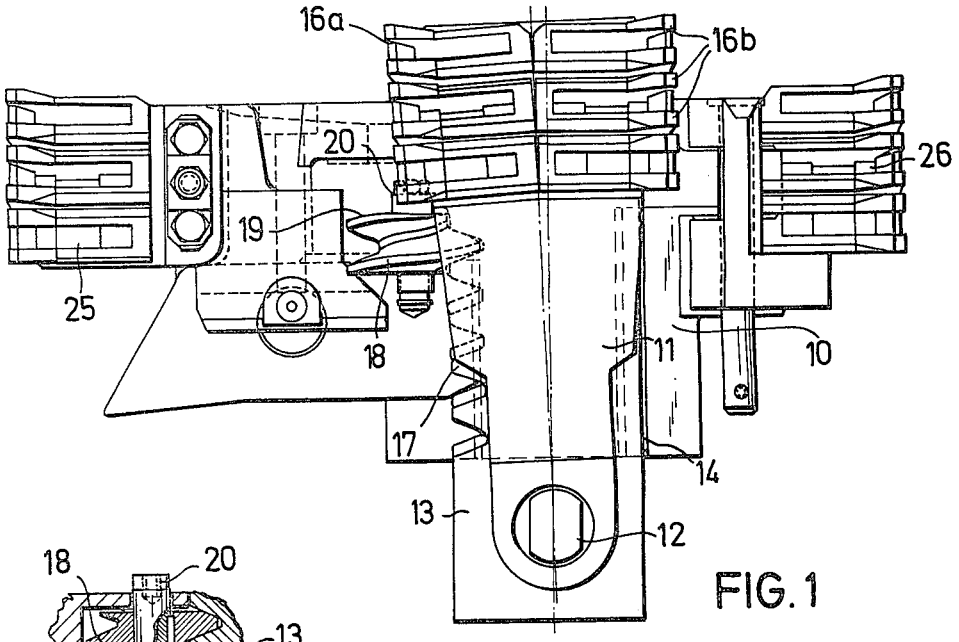
FIG. 1 is a side elevation, looking from the coal face of the upper part of the coal plough.
Figure 3:
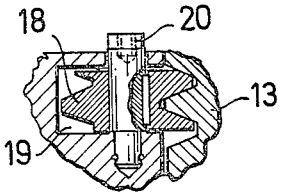
FIG. 3 is a cross-section taken on the line III—III of FIG. 2.
Figure 2:
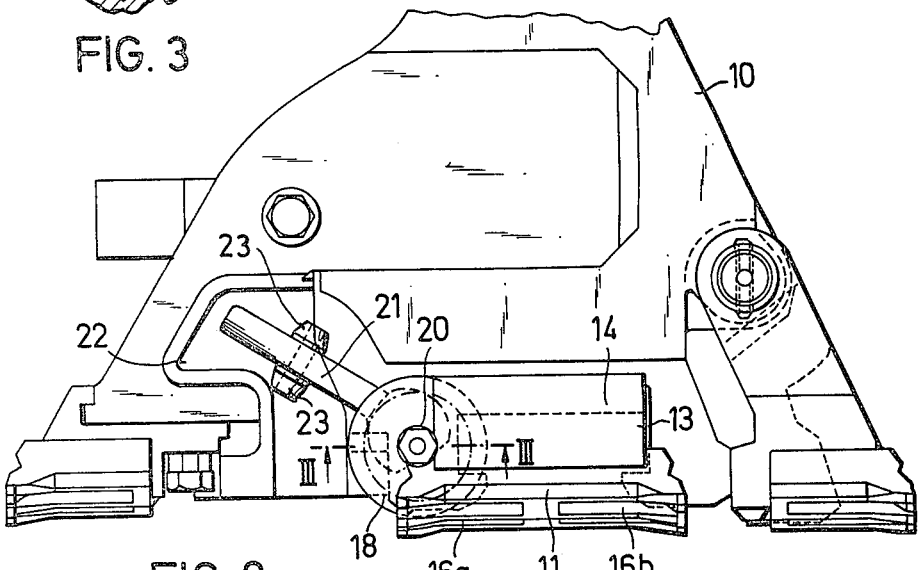
FIG. 2 is a plan view of the upper part of the plough.

Referring to the drawings, the plough has a plough body 10 (the upper part only of which can be seen) provided with a carrier 11 for two sets of roof cutters 16*a* and 16*b*. The carrier 11 is pivotally attached to a slider 13 by means of a pivot pin 12. The slider 13 is slidably mounted in a vertical T-shaped groove guide 14 associated with the plough body 10. Thus, the carrier 11 and the slider 13 are vertically adjustable relative to the plough body 10. The plough body 10 is slidably mounted on a guide (not shown) provided at the face side of a conveyor (not shown) which extends along the face.

The pivot pin 12 is positioned adjacent to the lower end of the slider 13, and its axis is perpendicular to the face and to the direction of movement of the plough along the face. Thus, the carrier 11 can be pivoted so that one set of roof cutters 16*a* or 16*b* is tilted into a working position for each direction of travel of the plough (the other set of cutters being tilted out of the working position for each direction of plough travel).

One side of the slider 13 is formed as a toothed rack 17 which meshes with a single-turn or double-turn worm 18. The worm 18 is rotatably mounted in a worm chamber 19 formed in the upper part of the plough body 10, by means of a worm shaft 20 which projects upwardly of the worm chamber, and extends beyond the upper surface of the plough body. A hand lever 21 is attached to the upper end of the shaft 20 by means of a hexagonal nut. The lever 21 is housed in a recess 22 formed in the upper surface of the plough body 10. Thus, by rotating the worm 18, by means of the lever 21, the slider 13 (and therefore the carrier 11) can be vertically adjusted in a continuous manner.

The worm drive 17,18 has no self-locking action. Instead, in order to fix the slider 13 (and hence the carrier 11) in a given vertical position, lever 21 can be secured against rotation by seating it between a pair of stops 23 constituting the ends of a U-shaped retainer fork, where it is held by pins extending through the stops. The stop pins are easily removable for the purpose of changing the vertical setting of the slider 13 and carrier 11. The carrier 11 is shown in its fully lowered position, in which the lower cutters of the sets 16*a* and 16*b* are at the same level as the upper main cutters 25 and 26 provided at the top of the plough body 10. The rest of the main cutters and the floor-level cutters cannot be seen in the drawings.

The use of a worm drive 17,18 as a displacement device enables a continuous height adjustment of the carrier 11 (and its roof cutters 16*a* and 16*b*) to be effected. Moreover, the provision of the lever 21 enables this vertical adjustment to be controlled from the goaf side of the plough. Furthermore, because of its high reduction ratio, the worm drive 17,18 requires no great manual force for its operation. Consequently, the carrier 11 can be adjusted easily, quickly and continuously from an easily accessible position. Another advantage of the worm drive 17,18 is that the meshing of the worm 18 with the rack 17 tends to force out any foreign matter pressed in the gaps between the teeth of the rack as the worm rotates, so that a certain self-cleaning effect is achieved.

We claim:

1. A plough for winning material from a mineral face, the plough having a plough body, a carrier for roof-level cutters, and means for adjusting the vertical position of the carrier with respect to the plough body, wherein the adjusting means is constituted by a worm mounted on the plough body and a toothed rack associated with the carrier, the worm meshing with the toothed rack, and wherein the toothed rack is formed on a slider which is attached to the carrier, the slider being vertically slidable within a guide formed in the plough body.

2. A plough according to claim 1, wherein the guide is a vertical T-shaped groove in the plough body.

3. A plough according to claim 1, wherein the worm is housed in a chamber formed at the top of the plough body.

4. A plough according to claim 1, wherein the worm has a double-turn thread.

5. A plough according to claim 1, wherein the worm is rotatable by means of a lever attached to the upper end thereof.

6. A plough according to claim 5, wherein stop means are provided on the plough body for securing the lever against rotation for all vertical settings of the carrier.

* * * * *